US005150107A

United States Patent [19]

Kurisu

[11] Patent Number: 5,150,107

[45] Date of Patent: Sep. 22, 1992

[54] SYSTEM FOR CONTROLLING THE DISPLAY OF IMAGES IN A REGION OF A SCREEN

[75] Inventor: Motohiro Kurisu, Fremont, Calif.

[73] Assignee: Zilog, Inc., Campbell, Calif.

[21] Appl. No.: 771,819

[22] Filed: Oct. 7, 1991

Related U.S. Application Data

[63] Continuation of Ser. No. 396,963, Aug. 22, 1989, abandoned.

[51] Int. Cl.[5] ..... G09G 1/06

[52] U.S. Cl. ..... 340/724; 340/727; 340/798

[58] Field of Search ..... 340/720, 723, 724, 727, 340/794, 798, 799; 395/157, 156

[56] References Cited

U.S. PATENT DOCUMENTS

| | | | |
|---|---|---|---|
| 4,470,043 | 9/1984 | Sorensen et al. . | |
| 4,611,202 | 9/1986 | DiNitto et al. . | |
| 4,618,859 | 10/1986 | Ikeda | 340/724 |
| 4,642,626 | 2/1987 | Bruce | 340/723 X |
| 4,660,154 | 4/1987 | Dodge | 340/720 X |
| 4,766,427 | 8/1988 | Abe et al. | 340/723 X |
| 4,812,834 | 3/1989 | Wells | 340/723 X |
| 4,831,368 | 5/1989 | Masimo et al. | 340/720 |

*Primary Examiner*—Ulysses Weldon

*Attorney, Agent, or Firm*—Majestic, Parsons, Siebert & Hsue

[57] ABSTRACT

The device of this invention controls a cathode ray tube (CRT) in order to display desired images on a selected region of the screen. Locations on the screen are identified by horizontal and vertical addresses. The device comprises means for storing information to be displayed on the screen of the cathode ray tube and a control means. The control means selects information for display and generates a display control signal for controlling the cathode ray tube. The display control signal causes the cathode ray tube to display the selected information and also indicates a predetermined vertical or horizontal address. When the display control signal indicates a horizontal address, the control means displays selected information only in the region of the screen above or below the horizontal address and not in the remainder of the screen. When the display control signal indicates a vertical address, the control means displays selected information only in the region of the screen to the left or the right of the vertical address and not in the remainder of the screen.

9 Claims, 3 Drawing Sheets

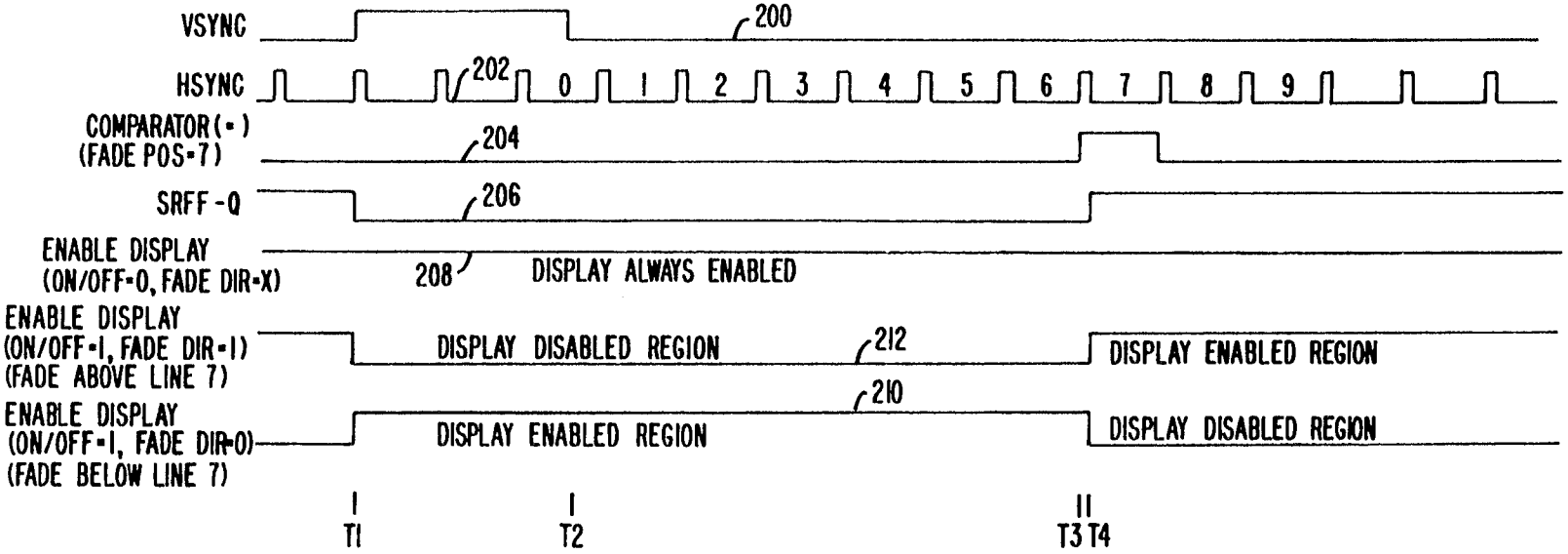
FIG._3.
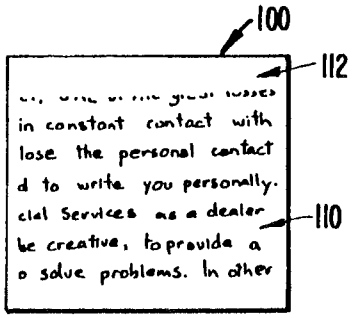
FIG._4a.
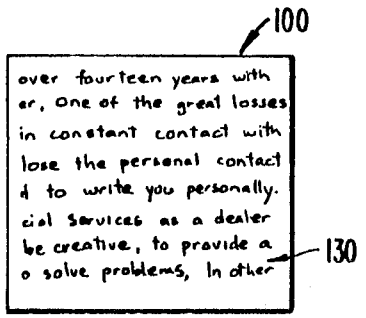
FIG._4b.
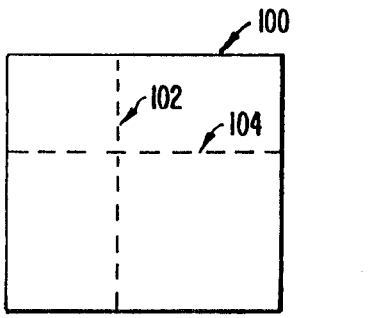
FIG._4c.
FIG._4d.

SYSTEM FOR CONTROLLING THE DISPLAY OF IMAGES IN A REGION OF A SCREEN

This is a continuation of application Ser. No. 396,963, filed Aug. 22, 1989, now abandoned.

BACKGROUND OF THE INVENTION

This invention relates in general to on-screen display controllers, and more specifically to a device for displaying information in a selected region of a screen.

While it is possible in the prior art to scroll text information in either the whole or split screen, it is not possible to fade a region of the text in or out. Instead, an entire screenful of information is displayed in sequence.

SUMMARY OF THE INVENTION

The device of this invention controls a cathode ray tube (CRT) in order to display desired images on a selected region of the screen. Locations on the screen are identified by horizontal and vertical addresses. The device includes means for storing information to be displayed on the screen of the cathode ray tube and a control means. The control means selects information for display and generates a display control signal for controlling the cathode ray tube. The display control signal causes the cathode ray tube to display the selected information and also indicates a predetermined vertical or horizontal address. When the display control signal indicates a horizontal address, the control means displays selected information only in the region of the screen above or below the horizontal address and not in the remainder of the screen. When the display control signal indicates a vertical address, the control means displays selected information only in the region of the screen to the left or the right of the vertical address and not in the remainder of the screen.

The purpose of this invention is to enhance the aesthetics of screen displays, such as menu changes, by fading in or out a part of a menu. In one embodiment, the vertical location of the region to be faded can be programmed to begin at any location within the menu display, including any line of a character. An entire screen may be gradually faded, or only part of a screen may be faded. Since the vertical location may be incremented or decremented over time, the viewer can see the bottom line of information moving up or down the screen.

By using this invention, menu changes are gradually and smoothly made, mitigating the abruptness of a complete replacement of one menu by the next. This invention also has the advantage of alerting the viewer to a menu change, in case he inadvertently pushes the wrong button on the remote control.

BRIEF DESCRIPTION OF THE DRAWINGS

FIG. 3 is a timing chart for the circuit of FIG. 2. For purposes of illustration, the desired location for fading is arbitrarily set to line seven of the video field.

FIGS. 4(*a*) through (*d*) show a CRT screen. FIG. 4(*a*) shows a location on the screen identified by a vertical and a horizontal address. FIG. 4(*b*) shows a full screen character display of eight rows of twenty characters each. FIG. 4(*c*) shows a partial screen character display, with the upper region of the screen faded out. FIG. 4(*d*) shows a partial screen character display, with the lower region of the screen faded out.

DETAILED DESCRIPTION OF THE INVENTION

A summary of the television transmission process is helpful background information. A linear scanning process is used to break down a television picture for transmission. The image information in the resulting video signal is used at the receiver to control an electron gun in a CRT, where the gun sweeps across a screen along nearly horizontal parallel lines that together make up the television picture.

When the video signal is processed at the receiver, it requires a means of synchronizing with the televised scene exactly as scanned by the transmitter camera tube. The speed of the receiver scanning line must duplicate that of the transmitter scanning line so that the top of the scene appears at the top of the screen and not elsewhere. When the horizontal beam reaches the end of the bottom line of the televised scene, it must retrace back to the beginning of the top line without being seen, simultaneously at both transmitter and receiver. During the retrace, the electron beam at the receiver must be blanked out (turned off) by a high amplitude signal that turns off the electron gun while the scanning circuits retrace the beam. The electron gun is similarly turned off during the vertical retrace, although for a longer time interval.

The scanning process requires a means of coordinating the transmitter and receiver. To accomplish this objective, the transmission system generates synchronizing signals to be used by the receiver, so that it stays in step with the transmitter. Two sets of synchronization signals are transmitted—horizontal (HSYNC) pulses and vertical (VSYNC) pulses. During each horizontal retrace, a HSYNC pulse is transmitted which is not seen on the screen since the beam is turned off. Similarly, the VSYNC pulse transmitted during each vertical retrace interval is not visible.

Figure 1:
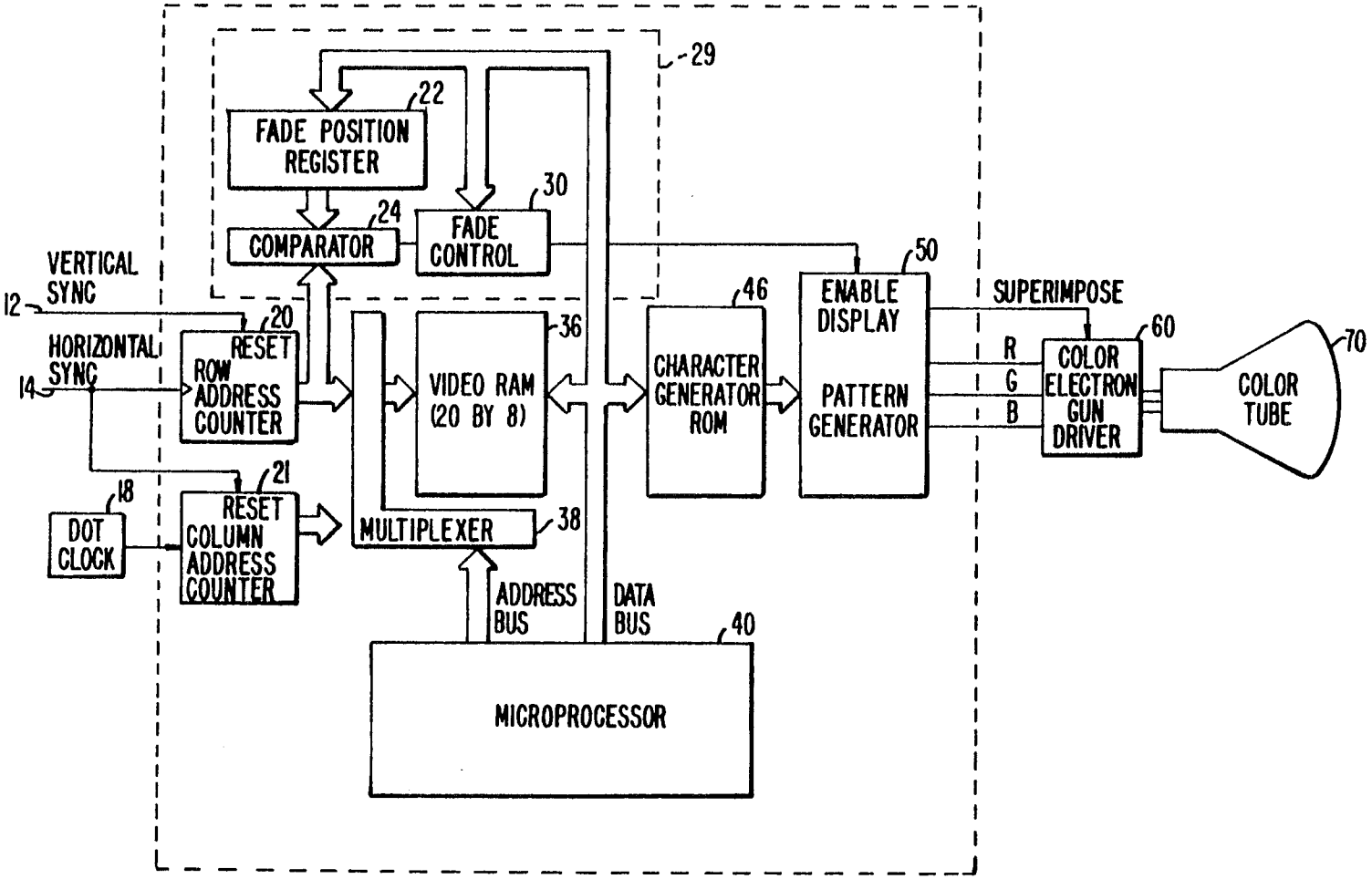
FIG. 1 is a block diagram of a device for displaying selected information on a CRT screen in a designated region to illustrate an embodiment of the invention. In this embodiment, the information display may be turned off on the screen above or below a designated vertical location.

In this invention, two modes of operation are possible: full screen display and partial screen display. In the embodiment of FIG. 1, the information made to fade in or out is from storage, and not signals from the incoming television signal. In full screen display mode, the device displays stored characters over the entire CTR screen 130 (FIG. 4(*b*). In partial screen display mode, the device displays stored characters in part of the screen 110, 120 (FIGS. 4(*c*), 4(*d*)) by turning off the electron gun output during part of the vertical sweep, i.e. for all the horizontal scans above or below a designated vertical location 104 (FIG. 4(*a*)).

The following discussion of full screen display mode refers to FIGS. 1, 4(*a*) and 4(*b*). In this mode, the controller can display a full screen having up to eight rows by twenty columns of characters 130. The fade control circuit 29 is not active. VSYNC 12 resets the row address counter 20 to synchronize the incoming video frame. HSYNC 14 drives the row address counter 20 which shows the vertical location 104 of the last line displayed. The row address counter 20 generates a three bit row address to video RAM 36 and a four bit row address to character generator ROM 46. The dot clock 18 drives the column address counter 21 which shows the horizontal location 102 of the last character displayed. The column address counter 21 generates a five bit column address to video RAM 36.

The microprocessor 40 uses the three bit row address and the five bit column address to fetch character data stored in video RAM 36. The microprocessor 40 uses the video RAM 36 data output to address a character pattern from the character generator ROM 46. The character pattern is used by the pattern generator 50 to send color control signals to the color electron gun driver 60 that cause the character to be displayed on the screen 100 of the color tube 70. The pattern generator 50 also generates a signal to superimpose character images on the display of the incoming television signal. This sequence is repeated for each column of every row to display a full screen of stored characters.

Partial screen display mode is activated by programming the device to turn off a region of the stored character display beginning or ending at a designated vertical location 104 on the screen. The microprocessor 40 loads the fade position register 22 with the vertical location 104 where fading is to begin. The fade control activator 30 switches on the fade control circuit 29. The fade control circuit 29 causes the pattern generator 50 to superimpose a blanking pulse that turns off the electron gun driver 60 so that no character images are displayed in the desired region of the color tube screen 70. The display of stored characters continues on the remainder of the screen.

On each VSYNC pulse, the row address counter 20 is reset to zero. On each HSYNC pulse the row address counter 20 is incremented, indicating the vertical location of the last line displayed on the screen. The comparator 24 compares the contents of the row address counter 20 and the fade position register 22, which contains the vertical location where fading is to begin. The comparator 24 output is low until the row address in the counter 20 equals the vertical location in the register 22. When the two addresses are equal, the comparator output changes to high. It remains high until the next HSYNC pulse, at which time the row address counter 20 is incremented so that it is greater than the fade position register 22. The comparator output then changes back to low.

Figure 2:
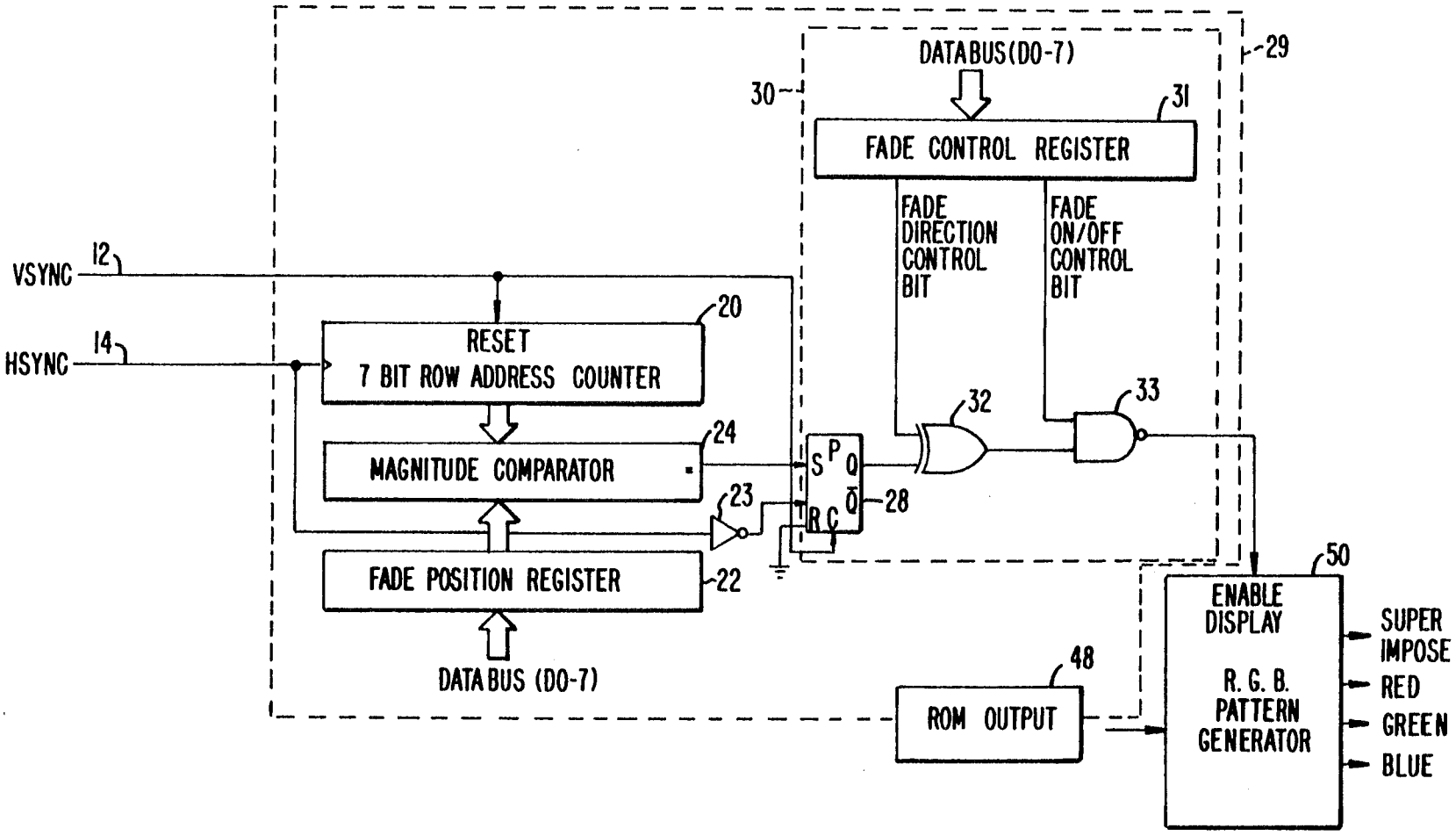
FIG. 2 is a circuit diagram showing in more detail the fade control logic of the controller system of FIG. 1.

The following discussion refers to FIG. 2 which is a circuit diagram of the fade control logic 29 that turns off the display in part of the screen when the comparator 24 output is high. The comparator 24 output is applied to the S input of the clocked RS flip flop 28. The S input is low until the line specified in the fade position register has been displayed. The clock input is the HSYNC pulse inverted by the inverter 23, so that the flip flop changes state on the falling edge of the HSYNC pulse. This results in the display being turned off at the line specified in the fade control register. The R input is low because it is grounded. The characteristic table for such a flip flop is shown below, where $Q_o$ is the Q output of the flip flop before the clock pulse:

| $S_o$ | $R_o$ | Q |
|---|---|---|
| 0 | 0 | $Q_o$ |
| 1 | 0 | 1 |

Note that this table shows the input states, S and R, before the clock pulse, and the output, Q, after the next clock pulse.

The circuit states as a function of time are shown in the timing chart of FIG. 3 for the case where fading is to begin at line seven. The microprocessor 40 loads the fade position register 22 with the value seven and sets the fade control bit **31*b* to 1 ("on") and the fade direction bit 31*a* to 0 ("below"). The VSYNC pulse 200 begins at time T1 and ends at time T2. From T1 to T2, three HSYNC pulses are transmitted during the VSYNC pulse. At T2, the row address counter 20 is reset to zero by the VSYNC pulse and incremented thereafter on every HSYNC pulse. The comparator 24 compares the contents of the row address counter 20 to the fade position register 22 which has been set to seven. At T3, after the seventh HSYNC pulse, the row address counter has the value seven, and the comparator output changes from 0 to 1. At this time, the fade control circuit 29 is activated and the RS flip flop changes state. At T4, the Q output of the flip flop 28 changes to 1 on the falling edge of the HSYNC pulse 204. Even though the comparator output falls low when the counter exceeds seven, the RS flip flop 28 remains high for the remainder of the current screen display, 206**, until it is reset by the next VSYNC pulse.

The fade control activator circuit 30 switches on the fading function and specifies whether display in the upper region (above line seven) of the screen 112 or in the lower region (below line seven) of the screen 122 is to be disabled. Line seven itself is enabled. The fade control activator 30 controls the input to the RGB pattern generator 50. If fading is on, the RGB pattern generator 50 does not supply any superimpose or RGB output, thereby turning off the character display for a region of the screen. If fading is off, full screen display continues.

The following truth table summarizes the fade control activator circuit 30:

| Output | Fade Function Not Used | | Fade Below | | Fade Above | |
|---|---|---|---|---|---|---|
| RSFF Output | 0 | 1 | 0 | 1 | 0 | 1 |
| Fade Direction | x | x | 0 | 0 | 1 | 1 |
| Fade on/off | 0 | 0 | 1 | 1 | 1 | 1 |
| Enable Display | 1 | 1 | 1 | 0 | 0 | 1 |

The RS flip flop output is one input to the XOR gate 32. The other input is the fade direction control bit **31*a* in the fade control register 31. When the RS flip flop 28 is high and the fade direction bit 31*a* is zero, the character lines from the current location to the bottom of the screen are not displayed. This state is known as "fade below." When the RS flip flop 28** is high and the fade direction bit is one, the character lines above the current location are not displayed. This state is known as "fade above."

The NAND gate 33 combines the output of the XOR gate 32 and the fade on/off bit from the fade control register 31. When the fade on/off bit is one, the fading circuit 29 is activated. If "fade below" is specified by setting the fade direction control bit to 0, no character image is displayed below the designated vertical location. This is the "display disabled" region area shown between T1 and T4 on line 210. Similarly, if "fade above" is specified by setting the fade direction control bit to 1, no character image is displayed above the designated vertical location. This is the "display disabled" region shown after T4 on line 212. Display of the television image continues as "background" to the character display below the designated vertical location.

The process described above results in the stored character display being turned off at the specified vertical location. Progressive fading downward or upward on the screen from that location can be implemented by incrementing or decrementing the fade position register on every vertical sweep. Thus, successively more or fewer lines are displayed on the screen during each vertical sweep, so that the viewer sees the displayed region increasing and decreasing. Another embodiment of the invention implements the same fading process in a horizontal direction, i.e. from left to right or right to left on the screen by rotating screen 100 by 90 degrees. In both embodiments, the device can be programmed to fade a band of the screen, so that text is displayed above a given line and below a second line but not in between. The television image is displayed in the parts of the screen where text is not displayed.

While the present invention has been particularly described with reference to FIGS. 1–4, it should be understood that the specific embodiments are for illustration only and should not be taken as limitations upon the invention. For example, the invention may be used to fade television video images and computer monitor displays. It is apparent that the method and apparatus of the present invention have utility in any display device desired. It is contemplated that many changes and modifications may be made by one of ordinary skill in the art without limiting the scope of the invention as disclosed above.

What is claimed is:

1. A device for controlling a cathode ray tube in order to display desired images on a screen of the tube, locations on said screen being identified by horizontal and vertical addresses, said screen having row addresses, said device comprising:

means for storing information to be displayed on the screen of the cathode ray tube;

control means for selecting information for display from said storing means, said control means including means for storing a row address of the screen, a row address counter which counts in response to a horizontal synchronization signal, comparator means for comparing the row address stored in the row address storage means to the count of the counter, said comparator means having an output indicating the result of the comparison, and means for generating a display control signal as a function of the output of the comparator means, for controlling the cathode ray tube so that said cathode ray tube displays the selected information, said display control signal also indicating a predetermined horizontal address;

said control means being such that when said display control signal indicates a horizontal address, selected information is displayed only in the portion of the screen above or below said horizontal address and not in the remainder of the screen; and where the position of said displayed information remains fixed relative to said screen.

2. The device of claim 1, wherein said horizontal address indicated by the display control signal is capable of being incremented or decremented over time.

3. The device of claim 1, wherein said controller means includes a microprocessor means for selecting information from the first storing means for display and means for generating the display control signal.

4. The device of claim 3, said display control signal generating means further comprising S-R flip-flop means for storing the output of the comparator means, said flip-flop being cleared by a vertical synchronization signal for operating the cathode ray tube, said flip-flop having an output, wherein the generation of said display control signal is responsive to the output of the flip-flop so that the display control signal is updated during each cycle of the vertical synchronization signal.

5. The device of claim 3, wherein said display control signal generating means is capable of altering the row address stored in the row address storing means during each cycle of the vertical synchronization signal, so that the information displayed is faded upwards or downwards.

6. The device of claim 3, said display control signal generating means further comprising a XOR gate having as inputs the output of the comparator means or a signal derived therefrom and a fade direction control signal, wherein said display control signal is generated as a function of the output of the XOR-gate, so that when the fade direction control signal is of a first value, information is displayed in a portion of the screen above but not below the row address stored in the row address storing means, and when the fade direction control signal is of a second value different from the first value, information is displayed in a portion of the screen below but not above such row address.

7. The device of claim 1, further comprising means for enabling or disabling the application of the display control signal to the display control signal generating means.

8. A method employing a device for controlling the fading of images displayed by a cathode ray tube in order to display desired images on a screen of the tube, locations on said screen being identified by horizontal and vertical addresses, said device comprising (a) first means for storing information to be displayed on the screen of the cathode ray tube; (b) a second means for storing a predetermined horizontal address; and (c) control means for selecting information for display from said storing means, said control means including a counter to monitor the horizontal address of the portion of the screen being addressed at any time, said control means generating a display control signal for controlling the cathode ray tube to display the selected information, said display control signal also indicating the horizontal address stored in the second storing means; said control means being such that when said display control signal indicates a horizontal address, selected information is displayed only in the portion of the screen above or below said horizontal address and not in the remainder of the screen; said method comprising:

(i) updating the contents of a counter in response to a first timing signal;

(ii) incrementing the contents of the counter in response to a second timing signal;

(iii) comparing the contents of the counter to the predetermined horizontal address and generating a result of the comparison;

(iv) generating a display control signal in response to the result of the comparison to display selected information in only a portion of the screen but not in the remainder of the screen where the position of said displayed selected information remains fixed relative to said screen; and (v) displaying the information in said only portion of the screen.

9. A device for controlling a cathode ray tube in order to display desired images on a screen of the tube, locations on said screen being identified by horizontal and vertical addresses, said screen having row addresses, said device comprising:

means for storing information to be displayed on the screen of the cathode ray tube;

control means for selecting information for display from said storing means, said control means including means for storing a row address of the screen, a row address counter which counts in response to a horizontal synchronization signal, comparator means for comparing the row address stored in the row address storage means to the count of the counter, said comparator means having an output indicating the result of the comparison, S-R flip-flop means for storing the output of the comparator means, said flip-flop being cleared by a vertical synchronization signal for operating the cathode ray tube, said flip-flop having an output, and means for generating a display control signal which is responsive to the output of the flip-flop so that the display control signal is updated during each cycle of the vertical synchronization signal, said display control signal for controlling the cathode ray tube so that said cathode ray tube displays the selected information, said display control signal also indicating a predetermined vertical or horizontal address;

said control means being such that when said display control signal indicates said horizontal address, selected information is displayed only in the portion of the screen above or below said horizontal address and not in the remainder of the screen; and where the position of said displayed information remains fixed relative to said screen.

* * * * *